United States Patent [19]

Pitcher

[11] Patent Number: 4,697,724

[45] Date of Patent: Oct. 6, 1987

[54] RESILIENT GLOVE TREE

[76] Inventor: Bruce Pitcher, 259 Los Prados Dr., Safety Harbor, Fla. 33572

[21] Appl. No.: 920,467

[22] Filed: Oct. 20, 1986

[51] Int. Cl.[4] ..... A41D 1/00

[52] U.S. Cl. ..... 223/78; 223/79; 2/158

[58] Field of Search ..... 223/78, 79, 80, 120, 223/66, 67; 2/158

[56] References Cited

U.S. PATENT DOCUMENTS

| | | | |
|---|---|---|---|
| 1,240,728 | 9/1917 | Jordan | 2/158 |
| 3,096,008 | 7/1963 | Schumacher | 223/78 |
| 3,133,682 | 5/1964 | Sawyer | 223/78 |
| 3,409,142 | 11/1968 | Mechaneck | 223/78 X |
| 3,486,670 | 12/1969 | Sutton | 223/78 |
| 3,917,266 | 11/1975 | Kiey | 223/78 X |
| 4,018,382 | 4/1977 | DiCuya | 223/78 |
| 4,209,913 | 7/1980 | Wallin et al. | 223/79 X |

*Primary Examiner*—Louis K. Rimrodt
*Assistant Examiner*—J. L. Olds
*Attorney, Agent, or Firm*—Ronald E. Smith

[57] ABSTRACT

A glove tree formed of a resilient material. The device includes a display stand means suitable for displaying a glove carried by the tree. The respective distal ends of the fingers and thumb of the glove tree or glove form are enlarged with respect to their respective proximal portions in order to save materials since the distal portions accomplish the spreading of the glove's fingers and thumb sections. Both the distal and proximal sections of the tree's fingers and thumb are semicircular in transverse section. Moreover, the palm portion of the form is solid but formed of the same resilient material as the fingers and thumb so that it may be squeezed as it is inserted into a glove and subsequently released to spread and fill the palm portion of a glove.

1 Claim, 5 Drawing Figures

RESILIENT GLOVE TREE

BACKGROUND OF THE INVENTION

1. Field of the Invention

This invention relates, generally, to glove trees, and more specifically relates to a resilient glove tree having a display stand.

2. Description of the Prior Art

It has long been observed that gloves become wrinkled and unsightly if not properly stored.

It has also been observed that some gloves are prone to become even more wrinkled and unsightly than other gloves because they are used in wet or damp environments. Golf gloves, for example, can easily become moist when dew is on the course.

When wet gloves are stored without proper ventilating means, they can become permanently wrinkled and their value is diminished.

A number of devices have been invented over the years to solve the glove storage problem, and all of the devices have advanced the state of the art as of the time they were created, but the art has not yet become fully developed. The ultimate glove tree, i.e., one that is free of the limitations of the known devices, does not appear in the prior art.

U.S. Pat. No. 3,486,670 to Sutton (1969), entitled "Glove Form," shows a glove tree with bifurcated fingers. Each half of a finger member is biased in a direction opposite to the other half so that when a glove finger is slid over the finger form the finger halves are constrained to converge toward and abut one another, but due to their resiliency the bias continues to urge the finger halves in opposite directions so the glove finger is spread in a desireable fashion and wrinkles are eliminated at least to some extent.

The Sutton device is quite flat when seen in side elevation, however, and has a rigid, "open frame-work" palm portion.

Another U.S. Pat. No. 3,917,266 to Kiey, awarded in 1975, shows a one piece glove dryer of rigid construction.

A glove form having mechanical means for varying the width of the hand member and for varying the distance between the finger members and hand portions is shown in U.S. Pat. No. 4,018,382 to DiCuya (1977). The DiCuya device, like the Kiey device, is rigid.

A 1984 patent to Shikatani, U.S. Pat. No. 4,472,836, shows a rigid glove form that is electrically heated and which is curved to help retain the curvature of gloves formed with curved fingers.

A glove form that includes a dehydrating agent to dry gloves placed thereon is shown in a 1986 patent to Rede and others (U.S. Pat. No. 4,565,287).

Thus, it is clear that the art teaches the use of rigid glove forms. The only resilience in the glove forms of the prior art appears in Sutton's finger forms, but such resilience is merely a laterally directed bias between bifurcated finger forms as aforesaid.

SUMMARY OF THE INVENTION

The present invention discloses, for the first time anywhere in the world, a glove tree having a palm portion formed of a resilient high impact plastic that can be squeezed as it is inserted into a glove so that it speads out once inside the glove.

The present invention also discloses finger and thumb members having a semicircular appearance when seen in end view or transverse section, said members having distal portions which are enlarged with respect to their respective proximal portions. The reduction in size of the proximal portions of the fingers saves materials because it is the distal portons of the fingers that perform the anti-wrinkling function of the device.

Moreover, a base member is disclosed upon which the novel glove forms can be mounted for display.

The preferred material of the present invention is polypropylene or polyethylene.

None of the patents of the prior art teach or suggest the use of polypropylene or polyethylene in a glove tree, nor do they teach or suggest the use of a resilient palm portion that can be momentarily squeezed as a glove is fitted over the form.

The present invention is not limited in its utility to golf gloves in that it has been specifically designed for gloves of all types.

It is an important object of this invention to advance the glove tree art by introducing a glove form having a flexible, resilient palm portion.

Another object is to advance said art by introducing finger members having distal and proximal sections of differing proportions so that material is saved on the less essential, proximal portion thereof.

Still another object is to provide a stand to facilitate the display of gloves in a retail setting.

The invention accordingly comprises the features of construction, combination of elements and arrangement of parts that will be exemplified in the construction hereinafter set forth, and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

Figure 1:
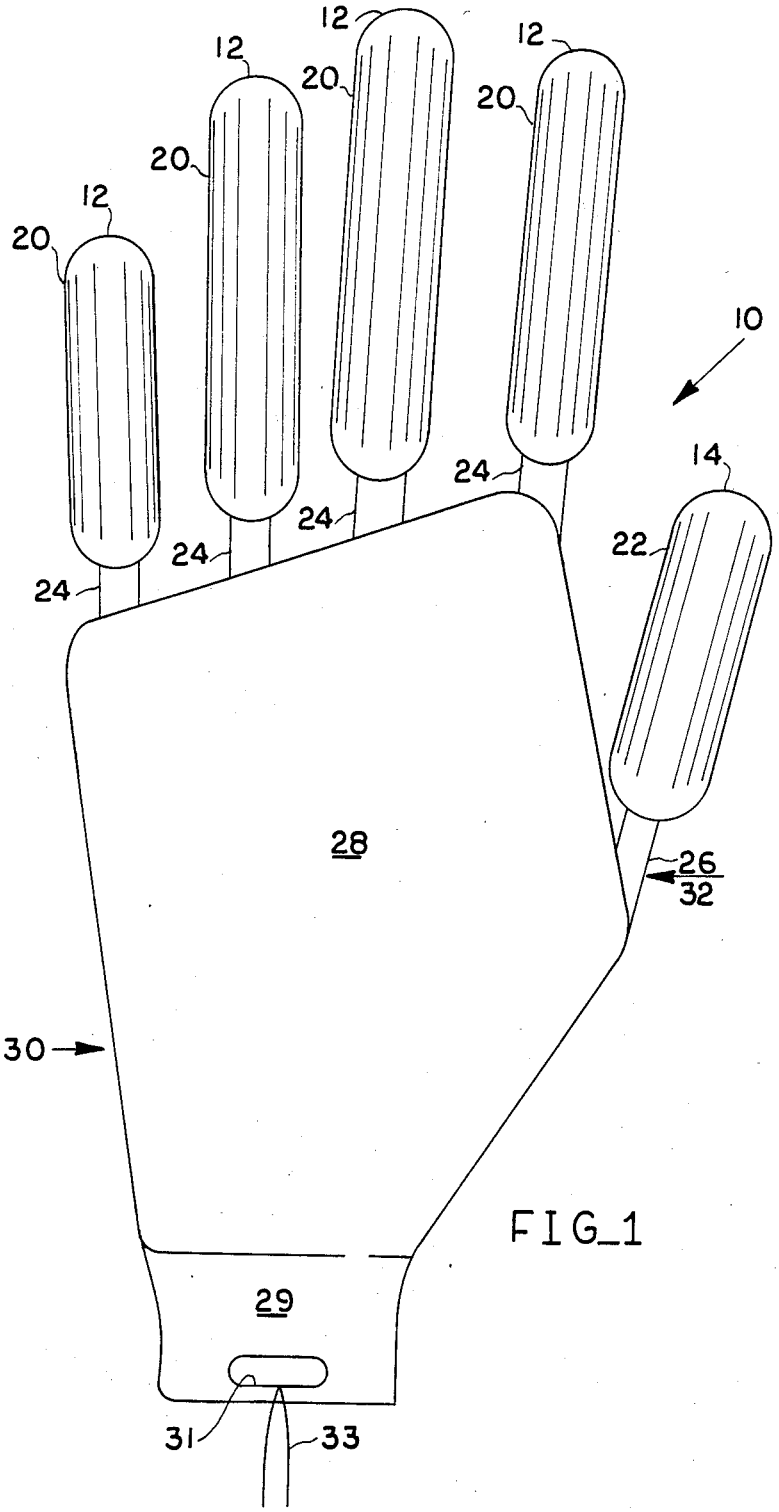
FIG. 1 is a top plan view of an illustrative embodiment of the invention.

Referring now to FIG. 1, it will there be seen that the novel glove form is designated by the reference numeral 10 as a whole.

Glove form 10 is formed as a single, unitary structure and is preferably formed of a high impact plastic such as polypropylene, polyethylene, or a suitable equivalent.

The fingers of glove form 10 are collectively designated 12 and the thumb portion thereof is denoted 14.

Figure 2:
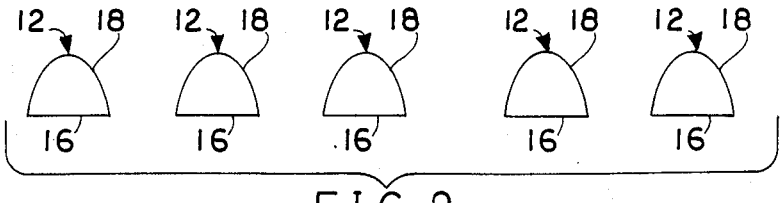
FIG. 2 is an end view of the finger members and thumb shown in FIG. 1.

As shown in FIG. 2, the fingers 12 and thumb 14 have a semicircular appearance when seen in end view or in transverse section, i.e., they have flat bottom surfaces 16 and arcuate top surfaces 18.

Figure 3:
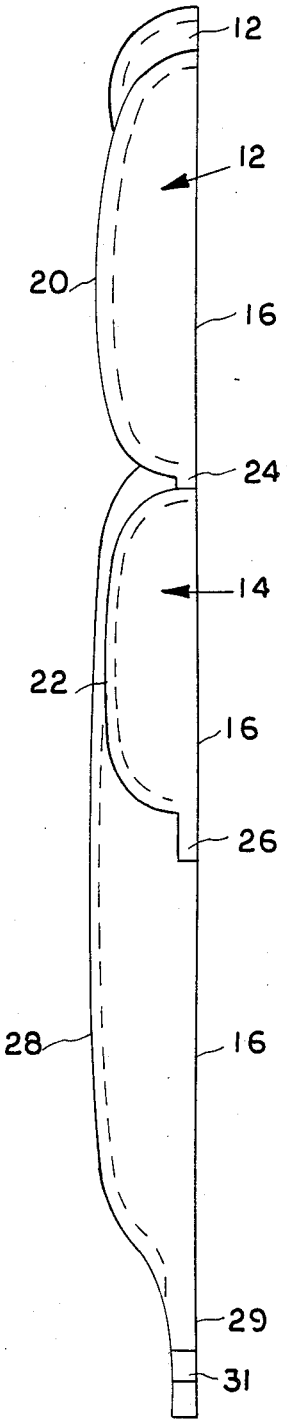
FIG. 3 is a side elevational view of the glove tree shown in FIG. 1.

Thus, two glove forms can be made out of one mold; the flat surfaces are formed where two members of a pair abut one another in the mold, as is perhaps best shown in FIG. 3 which FIG. further shows that the palm portion of the novel glove tree also has a flat bottom.

The semicircular shapes of the inventive fingers and thumb serve to shape the glove fingers and thumb without wasting material. A "full" glove tree, i.e., one having fingers and thumbs corresponding in transverse section to the transverse section of human digits, such as taught by several of the above-described patents of the prior art, uses about twice as much material as the novel design herein disclosed.

The earlier devices are constrained to use "full" digit forms because of their rigid construction. In sharp contrast to the teachings of the prior art, the present invention teaches that the use of the resilient materials disclosed herein obviates the need for "full" forms.

Thus, the ability of the inventive resilient finger and thumb forms to spread out and fill the voids in a glove's finger and thumb areas has the unexpected result of reducing the amount of materials needed in half.

Of course, the patentability of no invention rests on the presence of unexpected results, as a matter of law, but the presence of unexpected results does indicate that the present invention has advanced the art even further than expected.

The fingers and thumb have distal portions 20 and 22, respectively, and proximal portions 24, 26, respectively.

As depicted, the distal portions of the fingers and thumb are enlarged with respect to their associated proximal portions.

This particular feature of the invention also saves materials; the distal portions 20, 22 are the operative portions of said fingers and thumb and hence no substantial loss of function is incurred as a result of the size of the respective proximal portions 24, 26.

It is worth noting that the transverse sections of the respective proximal portions of the fingers and thumb are also semicircular, thereby further saving material without any diminution in performance.

Palm portion 28 has the general configuration of a human palm. Since it is formed of the same materials as the fingers and thumb, it too is resilient and may be compressed.

The lowermost portion of the palm 28 is denoted by the reference numeral 29 and will hereinafter be referred to as the wrist portion of glove form 10.

The thickness of wrist portion 29 is the same as the thickness of the proximal portions 24, 26 of the fingers and thumb as is clearly shown in FIG. 3.

An aperture 31 is formed centrally of wrist portion 29 and receives a string or cord member 33. Each form 10 has a cord 33 so that gloves which are members of a pair of gloves can be kept together through the tying together of their respective forms 10.

It has been found that squeezing palm portion 28 in the directions indicated by the single headed directional arrows 30, 32 when inserting form 10 into a glove enables the "Glove Saver" TM 10 to slide easily into place inside a glove. The palm 28 is released as it enters the corresponding palm portion of the glove to be protected against wrinkling, and it then rebounds to its original shape as depicted in FIG. 1, due to its resiliency.

This contrasts quite sharply with the Sutton device and the other glove forms of the prior art in that the palm portions of the earlier devices are incapable of being squeezed and thus cannot restore themselves to their original shapes once positioned within a glove.

Figure 4:
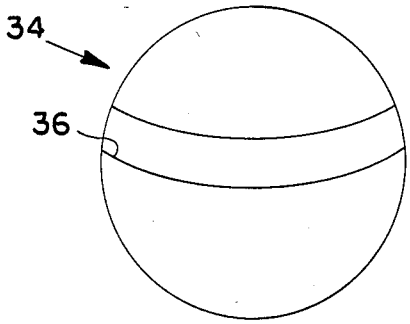
FIG. 4 is a top plan view of the novel base.
Figure 5:
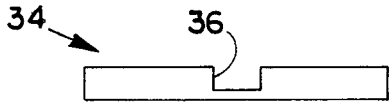
FIG. 5 is a side elevational view of the base shown in FIG. 4.

When it is desired to display a glove for retail purposes, the display stand depicted in FIGS. 4 and 5 has great utility.

Base 34 includes an arcuate slot 36 formed therein which receives the wrist portion 29 of glove form 10 when said wrist portion has been bent to conform to the arcuate shape of slot 36.

A glove drying while positioned on glove form 10 carried by stand 34 will dry quickly as all surfaces are exposed to the air; thus, glove owners benefit as well from the availability of the stand 34, said stand not having utility in a retail setting exclusively.

Strings 33 may still be used to tie the forms 10 together when a pair of gloves is on display, thereby reducing the likelihood that a pair of gloves on display will suffer the loss of one of its members.

The elegant and ingenuous construction of the form 10 makes it economical to manufacture and thus makes it affordable to consumers.

It will thus be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A glove tree, comprising:

a resilient palm member of solid construction;

a plurality of resilient finger members integrally formed with said palm member and extending outwardly therefrom in the plane of said palm member;

a resilient thumb member integrally formed with said palm member and extending outwardly therefrom in the plane of said palm member;

each of said finger members and thumb member having a semicircular transverse section;

each of said finger members and said thumb member having an elongate distal portion and a truncate proximal portion;

said respective proximal portions being integral to said palm member;

said distal portions being enlarged in width and thickness relative to the width and thickness of said proximal portions;

said palm member and said finger members and thumb member respectively having a flat bottom surface and all of said flat bottom surfaces being coplanar with respect to one another;

said finger members, said thumb member and said palm member being deformable in any direction so that said glove tree is deformable as a unit into a space smaller than a space occupied by it in its non-deformed configuration to the end that said glove tree is inserted into a glove means in its deformed configuration and regains its non-deformed configuration after entry into said glove means;

said glove tree further comprising a wrist means, said wrist means being contiguous to and integal with said palm member and being positioned opposite to said finger members and thumb member;

an aperture means formed in said wrist means, centrally thereof;

a cord means slidingly received in said aperture means so that a first glove tree can be tied to a second glove tree;

a flat base plate member;

a slot means formed in said flat base plate member;

said slot means specifically configured and dimensioned to slidingly but snugly receive therein said wrist means so that said glove tree is displayed in an upstanding disposition when its wrist means is inserted into said slot means;

said slot means being arcuate in form so that insertion of said wrist means thereinto requires conforming said wrist means to the shape of said slot means;

and wherein said wrist means has a thickness substantially equal to the thickness of said finger and thumb proximal portions;

said thickness of said wrist means and of said proximal portions of said finger members and said thumb member being less than half the thickness of said finger member distal portions, said thumb member distal portion and of said palm member.

* * * * *